US006092247A

United States Patent [19]

Wilson

[11] Patent Number: 6,092,247

[45] Date of Patent: Jul. 25, 2000

[54] POWERED PATIENT LIFT VEHICLE

[76] Inventor: Harold R. Wilson, 6270 New Holland St., Hudsonville, Mich. 49426

[21] Appl. No.: 09/165,550

[22] Filed: Oct. 2, 1998

[51] Int. Cl.[7] ..... A61G 7/14; A61G 7/12

[52] U.S. Cl. ..... 5/86.1; 5/81.1 R

[58] Field of Search ..... 5/86.1, 86.1 R, 5/83.1, 89.1

[56] References Cited

U.S. PATENT DOCUMENTS

| | | | |
|---|---|---|---|
| 3,694,829 | 10/1972 | Bakker | 5/86.1 |
| 3,940,808 | 3/1976 | Petrini | 5/86.1 |
| 4,545,085 | 10/1985 | Feldt | 5/86.1 |
| 4,554,691 | 11/1985 | Daugherty | 5/81.1 R |
| 4,569,094 | 2/1986 | Hart et al. | 5/86.1 |
| 4,704,749 | 11/1987 | Aubert | 5/83.1 |
| 4,918,771 | 4/1990 | James | 5/86.1 |
| 5,117,516 | 6/1992 | Penner | 5/86.1 |
| 5,388,289 | 2/1995 | Casperson | 5/86.1 |
| 5,412,820 | 5/1995 | Richards | 5/86.1 |
| 5,459,891 | 10/1995 | Reeve et al. | 5/87.1 |
| 5,502,851 | 4/1996 | Costello | 5/86.1 |
| 5,560,054 | 10/1996 | Simon | 5/86.1 |
| 5,758,371 | 6/1998 | VanDyke et al. | 5/89.1 |
| 5,784,729 | 7/1998 | Dunn et al. | 5/86.1 |

FOREIGN PATENT DOCUMENTS

| | | | |
|---|---|---|---|
| 2414909 | 9/1979 | France | 5/86.1 |

OTHER PUBLICATIONS

"The Original Diana Lift" brochure, Barrier Free Lifts Inc., (4 pages).

"Samson" brochure, V. Guldmann A/S, Guldmann Inc., Jan./1998, (6 pages).

"MULTI•LIFT Personal Transfer Lift for Home & Car" brochure, (2 pages).

"SureHands Recreational Lifts" brochure, Lift and Transfer System, Inc., (4 pages).

*Primary Examiner*—Alexander Grosz

*Attorney, Agent, or Firm*—Flynn, Thiel, Boutell & Tanis, P.C.

[57] ABSTRACT

A lift and transfer device includes a wheeled chassis provided with an upright frame which at a lower end thereof connects to a pair of sidewardly spaced and rearwardly cantilevered support legs provided with floor-engaging drive rollers adjacent the rear free ends thereof. A lifting arm arrangement is pivotally supported on the frame adjacent an upper end thereof and is connected to an actuating device to control vertical swinging of the arm arrangement. The arm arrangement is preferably defined by a four-bar linkage which, at its outer free end, mounts a patient carrier. The latter is vertically moved by the lift arm arrangement in a controlled and stable manner so that its position is stably defined, and the patient carrier permits removable attachment thereto of a patient-engaging sling arrangement to provide stable support of the patient during use of the device for moving or transferring the patient. The support legs are swingable between inner and outer positions whereby the inner position of the legs provides a narrower and more compact arrangement to enable the lift to pass through standard doorways, whereas the outer position provides a flared enlarged opened space to facilitate positioning of a wheelchair or other object between the legs when transfer of a patient is desired.

17 Claims, 12 Drawing Sheets

POWERED PATIENT LIFT VEHICLE

FIELD OF THE INVENTION

This invention relates to a powered lift and transfer device for assisting physically handicapped persons in moving about and, more particularly, to a device for enabling such person to move from a wheelchair to a bed or other furniture or into or from a position sitting on a floor or a standing position, for permitting the person to be stably and securely supported thereon, and for permitting the device to be readily moved through conventional doorways.

BACKGROUND OF THE INVENTION

Numerous lift and transfer devices have been developed to assist handicapped persons with respect to movement between various positions such as between a wheelchair and a bed, or to a bath tub, or to assist the person in standing. While many of the known devices have performed in a satisfactory manner for some functions, nevertheless most such devices are limited with respect to the satisfactory performance of only one or a small number of functions, and are incapable of effectively permitting transfer or manipulation of the person over a wide range of functions.

Another problem experienced with many of the known lifts is the manner of support for the handicapped persons. Many conventional lifts utilize a harness or swing arrangement which is supported solely in a suspended manner from an overhead arm or beam, and this results in undesired freedom in that the harness readily swings and can be frightening to the person during transfer or during movement of the lift device.

Still another problem experienced with many of the known lifts is their inability to be powered driven and controlled by the person supported by the lift. That is, the known lifts having a wheeled chassis, and specifically lifts having side legs which are movable transversely between inner and outer positions, have typically required that the rolling movement of the lift be effected due to pushing thereof by a helper. Further, in those situations where a power assist is provided for moving the lift arm, the controlling of the movement of the lift arm has also typically been possible only by a helper, and not by the person supported from the lift arm.

Many of the known lift devices are also disadvantageous in that the supporting frame is often defined by a pair of widely spaced legs which, due to the overall width, prevents the device from being readily moved through conventional doorways. To improve on this, some known lifts have provided legs which can be swingably moved between inner positions which permit movement through doorways, and outer diverging positions which accommodate furniture therebetween, such as a wheelchair. With these latter known lifts, however, the swinging movement of the legs between the inner and outer positions is normally accomplished by a mechanism which is mechanical and involves some type of swinging lever mounted on the front frame of the lift, which front frame often comprises an upright central beam or post. This swinging lever generally cannot be operated by the handicapped person, but must be operated by a helper.

Some examples of known lifts are disclosed by U.S. Pat. Nos. 3,940,808, 4,545,085, 4,554,691, 4,569,094, 4,918,771, 5,117,516, 5,388,289, 5,412,820, 5,459,891, 5,502,851, and 5,560,054.

It is an object of this invention to provide an improved lift and transfer device for a handicapped person, which improved device is believed to provide improved functional capabilities and performance and is believed to overcome many of the disadvantages associated with prior such devices.

SUMMARY OF THE INVENTION

The lift and transfer device of the present invention includes a wheeled chassis provided with an upright frame which at a lower end thereof connects to a pair of sidewardly spaced and rearwardly cantilevered support legs provided with floor-engaging support rollers adjacent the rear free ends thereof. A lifting arm arrangement is pivotally supported on the frame adjacent an upper end thereof and is connected to an actuating device to control vertical swinging of the arm arrangement. The arm arrangement is preferably defined by a four-bar linkage (a parallelogram is the preferred embodiment) which, at its outer free end, mounts a patient carrier. The latter is vertically moved by the lift arm arrangement in a controlled and stable manner so that its position is stably defined, and the patient carrier permits removable attachment thereto of a patient-engaging sling arrangement to provide stable support of the patient during use of the device for moving or transferring the patient. This stability provides reasonable comfort to the person and minimizes anxiety and fear which a person typically experiences when supported on a lift.

The present invention also relates to an improved lift and transfer device, as aforesaid, wherein the front frame employs a pair of widely and sidewardly spaced corner supports or columns which provide an enlarged central open region therebetween to provide significant clearance space for the feet and legs of a person supported on the device, and which in fact permit the person's legs to project through the front frame without having to straddle any frame parts, thereby providing improved comfort, such as when a person is sitting or lying on the floor.

This invention also relates to an improved lift device, as aforesaid, which can be entirely operated and controlled by the person supported thereon, and for this purpose the lift device provides a controller, preferably a joystick-type controller, mounted on the patient carrier so as to be readily accessible to and easily controlled by the person supported on the lift, whereby the person can readily carry out a significant number of functions either by themselves or with only minimum assistance of a helper. More specifically, due to the stable support of the person on the lift and the provision of the readily accessible controller, the person supported on the lift can readily access the controller to provide self direction over the operation of the lift, including control over the swinging of the lift arm, the lateral displacement of the side legs, and the activation of the main drive wheels.

In the lift device of this invention, as aforesaid, the lifting arm arrangement enables the patient to be vertically moved over a significant vertical distance so as to assist in moving the person either into or out of a standing position, or in the alternative for moving the person either into or out of a sitting position on the floor.

The present invention also relates to an improved lift and transfer device wherein the bottom support legs are swingable between inner and outer positions whereby the inner position of the legs provides a narrower and more compact arrangement to enable the lift to readily pass through standard doorways, whereas the outer position of the legs provides a flared enlarged opened space therebetween to facilitate positioning of a wheelchair or other piece of furniture between the legs when transfer of a patient is desired, and the flared legs also provide increased stability during the transfer process.

The lift of the present invention, as aforesaid, includes a swing actuator associated with the legs which include retractable transverse roller assemblies adjacent the rear end of the legs so that when swinging movement of the legs is desired, a driving device is actuated which initially causes the transverse rollers to be extended into contact with the floor to effect raising of main drive rollers out of engagement with the floor, with further driving of the drive device causing the legs to be swingably moved from one of the positions to the other position due to rolling of the transverse rollers, with continued operation of the drive device causing the transverse rollers to be automatically retracted upon reaching the other position so that the main drive rollers resume engagement with the floor. With the legs swung into their outer angled or flared relationship, and with the drive rollers engaged with the floor, the drive rollers can be energized to permit the lift to be drivingly displaced with only minimal sideward slipping occurring between the main driver rollers and the floor.

Other objects and purposes of the invention will be apparent to persons familiar with devices of this general type upon reading the following specification and inspecting the accompanying drawings.

Figure 1:
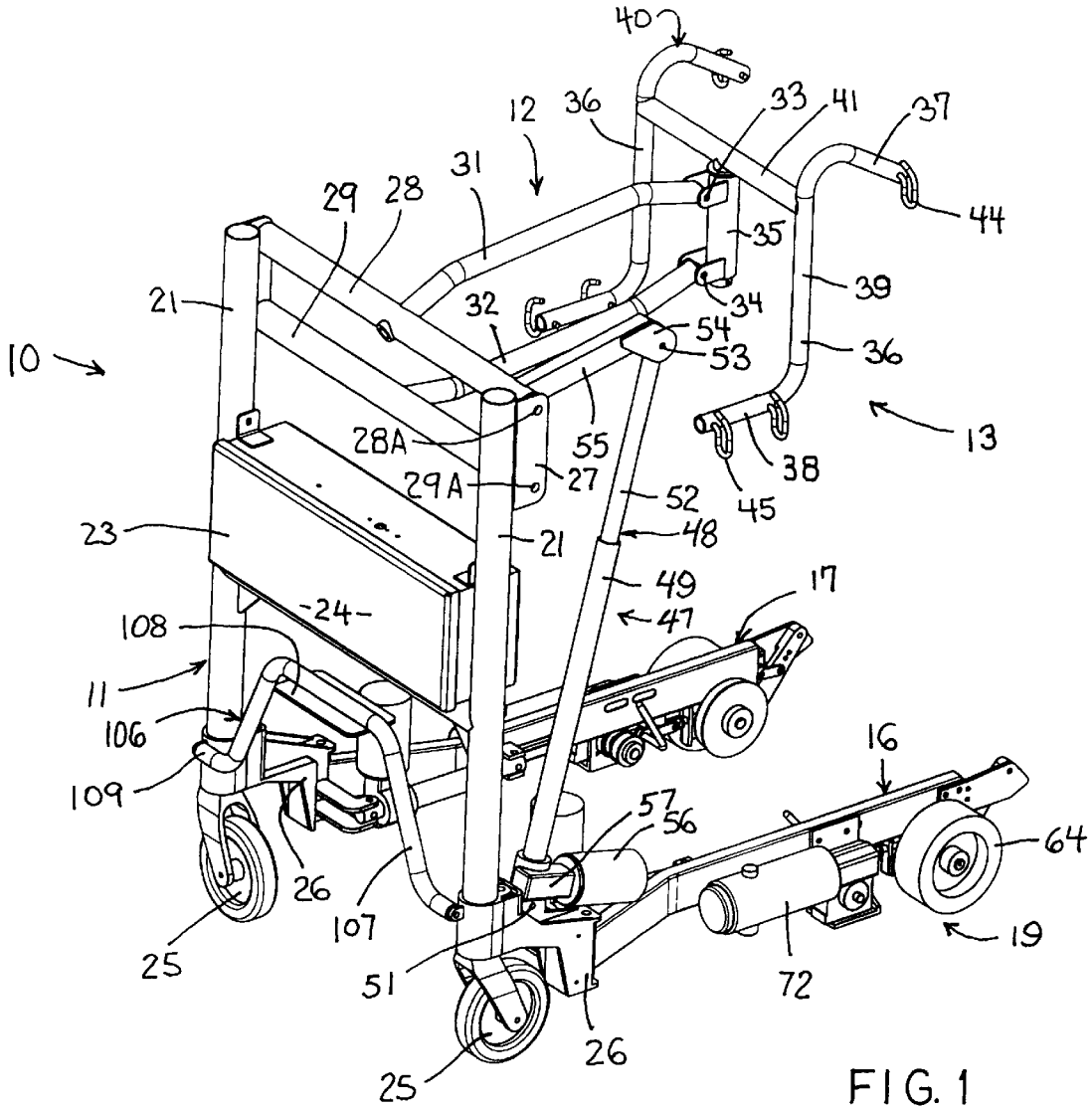
FIG. 1 is a front perspective view of the lift device of the present invention.
Figure 2:
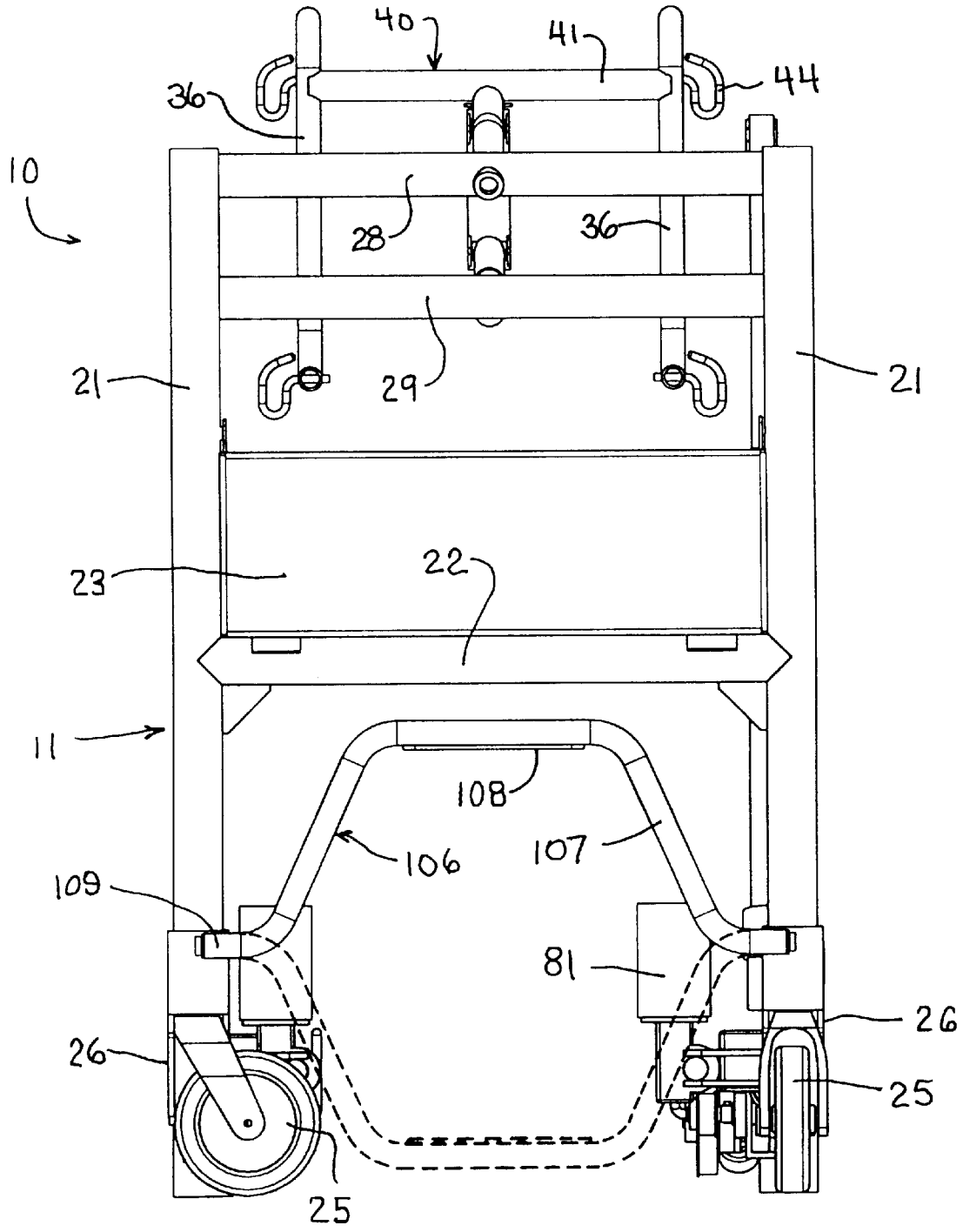
FIG. 2 is a front elevational view of the lift device.

Certain terminology will be used in the following description for convenience in reference only, and will not be limiting. For example, the words "upwardly", "downwardly", "rightwardly" and "leftwardly" will refer to directions in the drawings to which reference is made. The word "front" will refer to the end of the device having the upright frame, and the word "forwardly" will have reference to a direction of movement which is from right-to-left in FIG. 3. The words "inwardly" and "outwardly" will refer to directions toward and away from, respectively, the geometric center of the device and designated parts thereof. Said terminology will include the words specifically mentioned, derivatives thereof, and words of similar import.

DETAILED DESCRIPTION

Referring to the drawings and specifically FIGS. 1–4, there is illustrated a patient lift and transfer device 10 (hereinafter referred to solely as a "lift device") according to the present invention. In FIGS. 1–4 the support legs are disposed in their innermost position as typically assumed for permitting travelling of the lift device, and the lifting arm arrangement is disposed at an intermediate height location.

The lift device 10 has a wheeled chassis which includes an upright frame 11 at what is normally considered the front end of the device. A cantilevered lift arm arrangement 12 is pivotally supported on the upper part of the upright frame 11 and projects transversely rearwardly thereof. The lift arm arrangement 12 is supported for vertical swinging movement relative to the frame 11, and at its outer free end is provided with a stabilizing support 13 to which one or more slings, such as the slings 14 and 15 illustrated in FIG. 4, can be attached to provide support for a person.

The wheeled chassis of the lift device 10 also includes right and left side arms or legs 16 and 17 which connect to the lower corners of the upright frame 11 and are cantilevered rearwardly therefrom in sidewardly spaced relation. The legs 16 and 17 are swingably movable between inner and outer positions as respectively illustrated by FIGS. 4 and 7 and as explained hereinafter. Each leg 16, 17 has a swinging actuator 18 associated therewith for effecting movement of the respective leg between the aforementioned inner and outer positions. Each leg 16–17 also has a wheeled drive assembly 19 provided thereon adjacent the free end thereof.

The upright frame 11 includes a pair of generally parallel upright support columns or posts 21 which are sidewardly spaced apart and are rigidly joined, intermediate the ends thereof, by a cross bar 22 disposed to define a generally H-shape. A box 23 is positioned directly above the cross bar 22 and extends between and is rigidly joined to the upright support columns 21. The box 23 has a removable or openable cover 24 to provide access to the interior of the box, which interior is used for storage of the DC battery and associated electrical control hardware for the lift.

The wheeled chassis of the lift also includes front caster wheels 25 which are mounted adjacent the front ends of the legs 16, 17 and more specifically are mounted at the lower ends of the support columns 21. Arms or brackets 26 are fixed to and cantilevered rearwardly from the lower ends of the support columns 21.

The swinging lift arm arrangement 12 is pivotally mounted adjacent the upper end of the frame 11, and includes substantially parallel and horizontally extending upper and lower support bars or tubes 28 and 29, respectively, the latter extending generally transversely between the frame posts 21 and being rotatably supported at opposite ends thereof by pivots 28A and 29A on brackets 27 which are fixed to the frame posts 21 adjacent the upper ends thereof. The lift arm arrangement also includes upper and lower elongate lift arms 31 and 32 respectively, the latter having their forward ends fixedly secured to the respective upper and lower support bars 28 and 29. The elongate lift arms 31 and 32 project rearwardly generally perpendicularly from the center of the support bars 28 and 29 so as to be disposed substantially within the central vertical longitudinal extending plane of the lifting device. The lift arms 31–32 at their rearward ends are respectively joined by vertically-spaced horizontally-extended hinges 33–34 to a vertically elongate support column 35, the latter being a vertically elongate tube.

The lifting arm arrangement 12, specifically the upper and lower lift arms 31–32 and the parallel hinges or pivots 28A–29A and 33–34 provided at opposite ends thereof, define a vertically-oriented four-bar linkage which thus provides for a stable controlled movement of the patient support structure 13 which connects to the free end of the arm arrangement, whereby at any predetermined angle of the arm arrangement 12, the patient support structure 13 thus has a predetermined stationary position and is not subjected to undesired swinging movement. In the illustrated embodiment this four-bar linkage preferably comprises a parallelogram, as defined by the positions of the pivots 28A–29A and 33–34 so that throughout the vertical swinging movement of the lift arm arrangement, the patient support structure 13 remains stably and securely oriented in that its orientation in the vertical plane does not change, that is, the patient support structure 13 does not undergo any significant pivoting movement within the vertical plane relative to the frame of the lift device.

The patient support structure 13 in the preferred embodiment of the invention includes not only the aforementioned support 35, but also includes a supporting frame 40 which includes a pair of generally parallel and sidewardly spaced side frame elements 36, the latter being generally Z-shaped in the illustrated embodiment and each including respective top and bottom cantilevered legs 37 and 38 which oppositely project in the respective rearward and forward directions, and are rigidly joined by a generally vertically elongate intermediate leg 39. The side frame elements 36 are rigidly joined together by a generally horizontally extending cross bar 41 which extends between and is fixedly joined to the intermediate legs 39 adjacent the upper portions thereof. This cross bar 41, at the midpoint thereof, has a downwardly cantilevered support bar 42 which projects into and is rotatably supported within the support tube 35 so as to define a generally vertically extending pivot axis 43, thereby providing stable support for the support frame 40 while enabling the latter to be horizontally swingably displaced in either sideward direction so as to facilitate access to a person supported by the support frame 40, such as during a lifting and/or transferring operation, as explained hereinafter. The displacement of the support frame 40 in either sideward direction is indicated by the dotted line and dash-dot line positions indicated in FIG. 3.

The support frame 40 in the illustrated arrangement is provided with attachment points 44 and 45, such as attachment hooks, preferably in the vicinity of the free ends of the legs 37 and 38 associated with each of the side members 36. These attachment points or hooks 44–45 permit an appropriate patient-engaging structure such as slings 14 and 15 to be releasably attached to the support frame 40.

The swinging and positioning of the lift arm arrangement 12 is controlled by a lifting mechanism 47 which is preferably positioned sidewardly offset from the central plane of the lifting device so as to be disposed adjacent and generally substantially directly behind one of the upright support columns 21. This lifting mechanism 47 is defined primarily by an extendible ball-screw arrangement 48, the latter including an elongate lower tubular housing 49 which at its lower end is connected to one of the lower frame brackets 26 by a generally horizontal hinge 51. This lower tubular housing 49 rotatably supports therein an elongate screw member which is engaged with a surrounding ball-nut which is slidably supported within the housing 49 and is connected to the lower inner end of an upper elongate rod part 52 which is slidably extendible from the housing 49. This extendible rod part 52 at its upper end is joined by a further transverse horizontal hinge 53 to a bracket 54, the latter being secured to the outer free end of an elongate control arm 55 which projects radially outwardly from and has its opposite end fixedly secured to the upper support tube 28. The extendible ball-screw arrangement 48 is activated by a drive motor 56 which, acting through a conventional worm/gear arrangement 57, effects rotation of the screw shaft supported within the tubular housing 49. The housings of the motor 56 and worm/gear arrangement 57 are fixedly joined to the lower end of the tubular housing 49. The ball-screw lift mechanism 47 is a conventional unit, such as manufactured by Motion System Corporation, so that further description thereof is believed unnecessary.

Considering now the swingable leg arrangement 16 and 17, these leg arrangements as disposed adjacent the right and left sides of the device 10 are substantially identical, except for being mirror images relative to a central vertical plane of the device, and hence only the left leg arrangement 16 is illustrated in some of the figures.

The side leg arrangement 16–17 includes a horizontally elongate leg member 61 which mounts at its forward end a pivot member 62 which is pivotally supported on the respective frame bracket 26 so as to define a generally vertically extending hinge axis. The hinged cooperation between the leg member 61 and the frame bracket 26 preferably includes stops (not shown) which limit the permissible horizontal swinging movement of the leg member between inner and outer positions which are diagrammatically depicted by the dash-dot centerlines designated A and B in FIG. 3, thereby limiting the swinging movement of the leg member to an angle which will normally be in the range of from about 15° to about 30°, and is preferably about 20°.

The elongate leg member 61, adjacent the rearward free end thereof, mounts thereon the wheeled drive assembly 19 which includes a support roller or wheel 64 which is disposed adjacent the rearward free end of the leg member and is adapted for supportive and driving engagement with a floor. The wheel 64 is secured to a rotatable axle 65 which extends horizontally and transversely to the leg member, being supported by an appropriate bearing block 66, and having a driving pulley 67 secured to the inner end thereof. This driving pulley 67 in turn is engaged with a drive belt 68 which is driven by a drive pulley 69, the latter being driven through an appropriate speed reducing mechanism 71 by an reversible electrical drive motor 72, the latter being carried by the leg member 61. A manually swingable clutch lever 73 is associated with the drive assembly for creating an engaged or disengaged relation between the drive pulley and drive belt when disengagement of the drive wheel from the motor is desired.

The overall construction and operation of the wheeled drive assembly 19 is conventional, such assemblies being provided and utilized on powered wheelchairs, so that further detailed description thereof is believed unnecessary.

Figure 3:
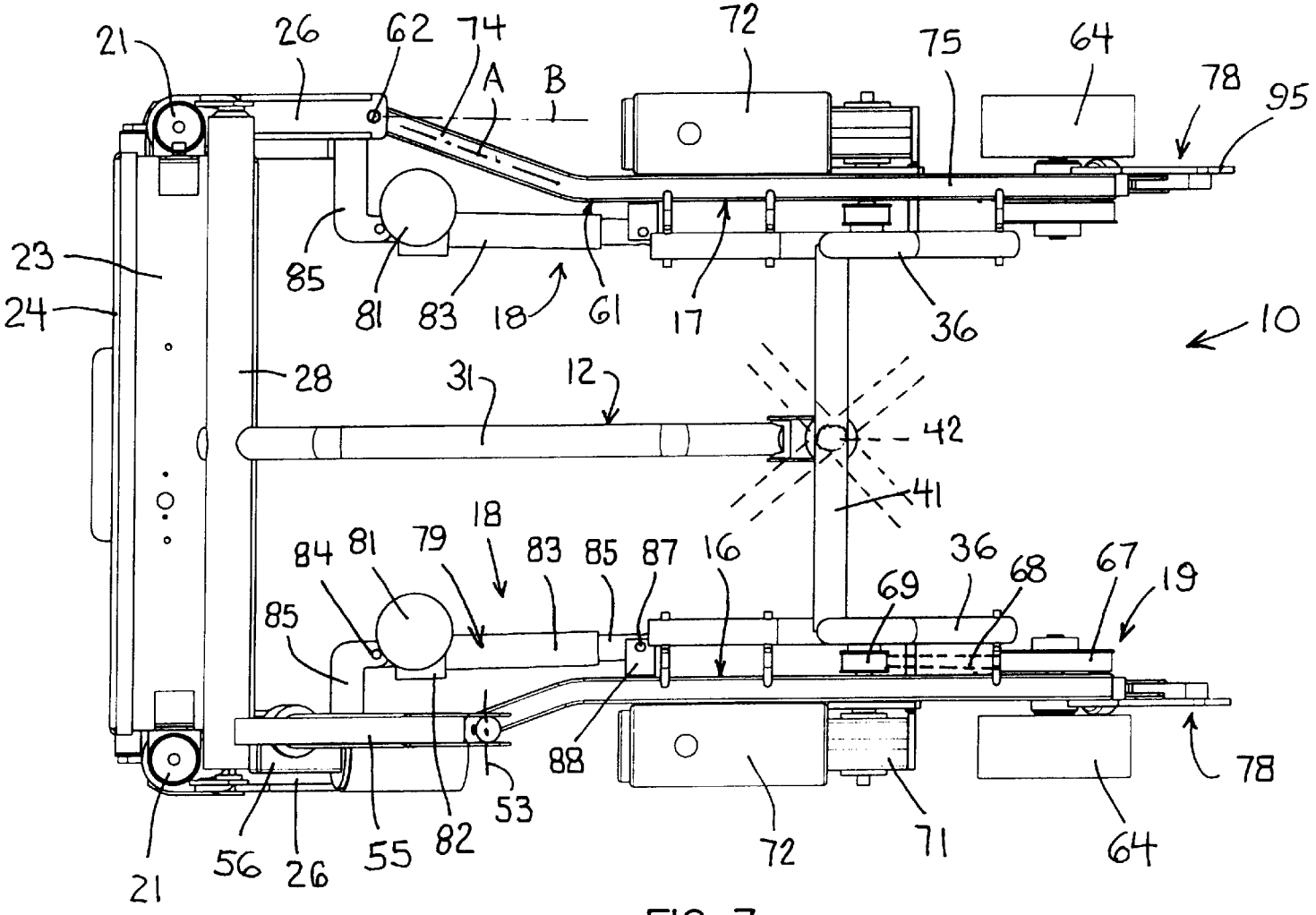
FIG. 3 is a top view of the lift device showing the side legs in their inner travelling positions.

The elongate leg member 61, as illustrated by FIG. 3, includes a front leg part 74 which extends generally at an obtuse angle relative to an elongate rear leg part 75, whereby the front leg part 74 adjacent its front end is hingedly joined to the respective frame bracket 26. With the legs in their inward positions substantially as illustrated in FIG. 3, this results in the rear leg parts 75 being disposed in generally parallel relationship and displaced sidewardly inwardly relative to the front frame brackets 26 and hinges 62. This results in the motor 72 and wheel 64 as mounted adjacent the outer side of each rear leg part 74 being positioned rearwardly of and generally aligned with the respective upright support column 21, whereby the overall device 10 when in the position of FIG. 3 has a substantially uniform width so as to permit its passage through normal doorways.

Figure 7:
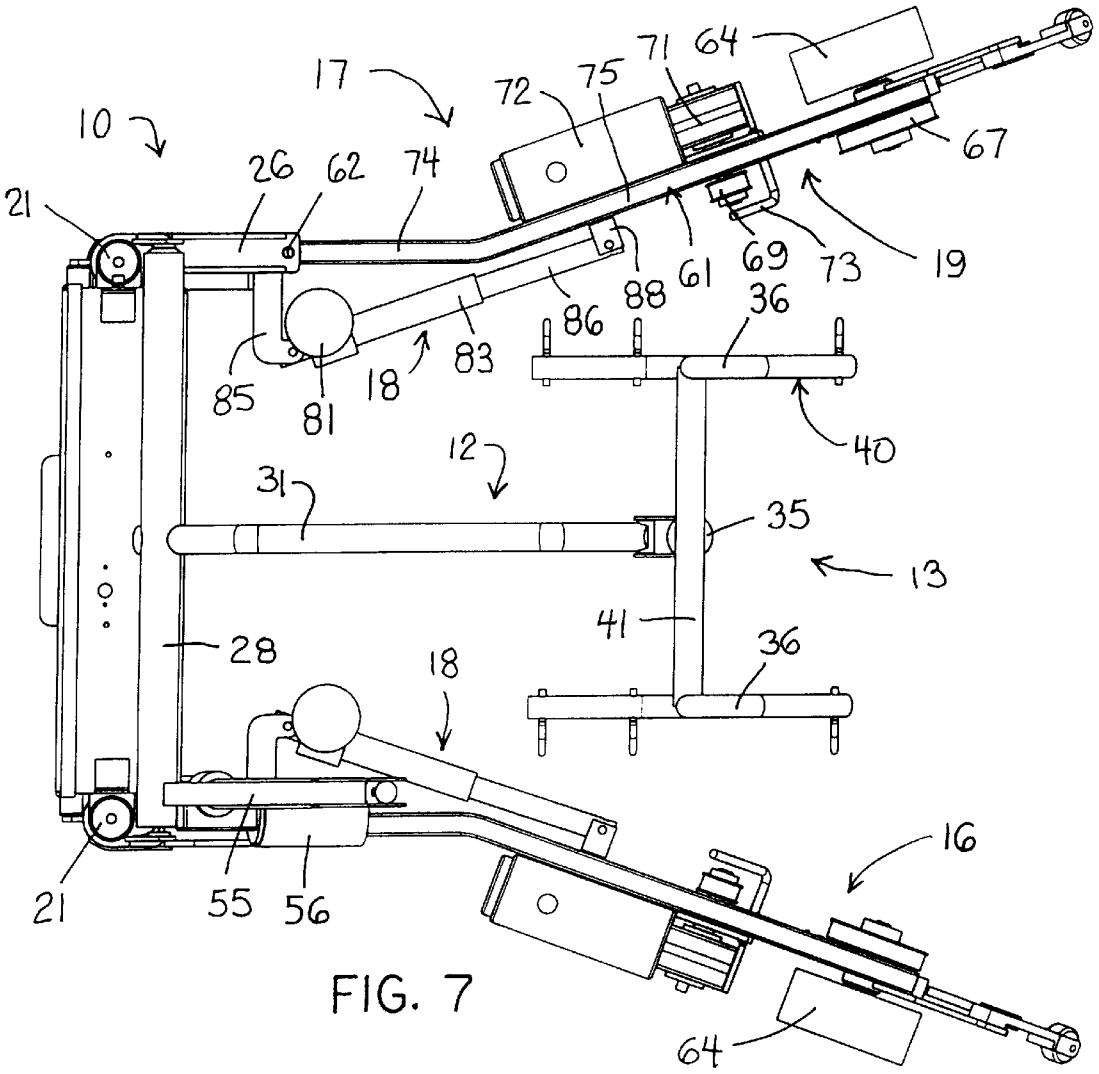
FIG. 7 is a top view similar to FIG. 3 but showing the swing legs in their outer or flared positions.

To swingably move the leg arrangement 16–17 between the inner and outer limit positions illustrated by FIGS. 3 and 7, each leg has the swing actuator 18 associated therewith, the latter including as a part thereof a transverse roller unit 78 which is disposed adjacent the free end of the respective leg member 61, and a drive unit 79 which cooperates between the front frame and the respective leg member 61 to activate the transverse roller unit 78.

The drive unit 79 is defined by a conventional screw-type linear actuator similar to the lifting mechanism 47 and includes a reversible electric drive motor 81 which acts through a power transmission 82 (such as a worm/gear arrangement) for effecting rotation of an elongate screw shaft (not shown) which is rotatably supported within an elongate tubular housing 83, the latter being connected by a vertical hinge 84 to an arm 85 which is fixed to the respective frame bracket 26. The rotatable screw within the elongate tubular housing 83 has a ball-nut engaged therewith which is secured to the inner end of an extendible elongate rod 86, the latter having its outer end connected via a hinge-type clevis 87 to a yoke 88. This yoke 88 in turn is slidably supported within a slot 89 which is elongated lengthwise along the sidewall of the rear leg part 75 of the leg member 61. The yoke 88 projects inwardly through the slot 89 and is secured to an elongate push rod 91, the latter being slidably supported within and projecting lengthwise of the rear leg part 75. This push rod 91 projects rearwardly out of the open rear end of the rear leg part 75 and is hingedly connected to a connecting link 92, the latter in turn being connected to the transverse roller unit 78.

Figure 8:
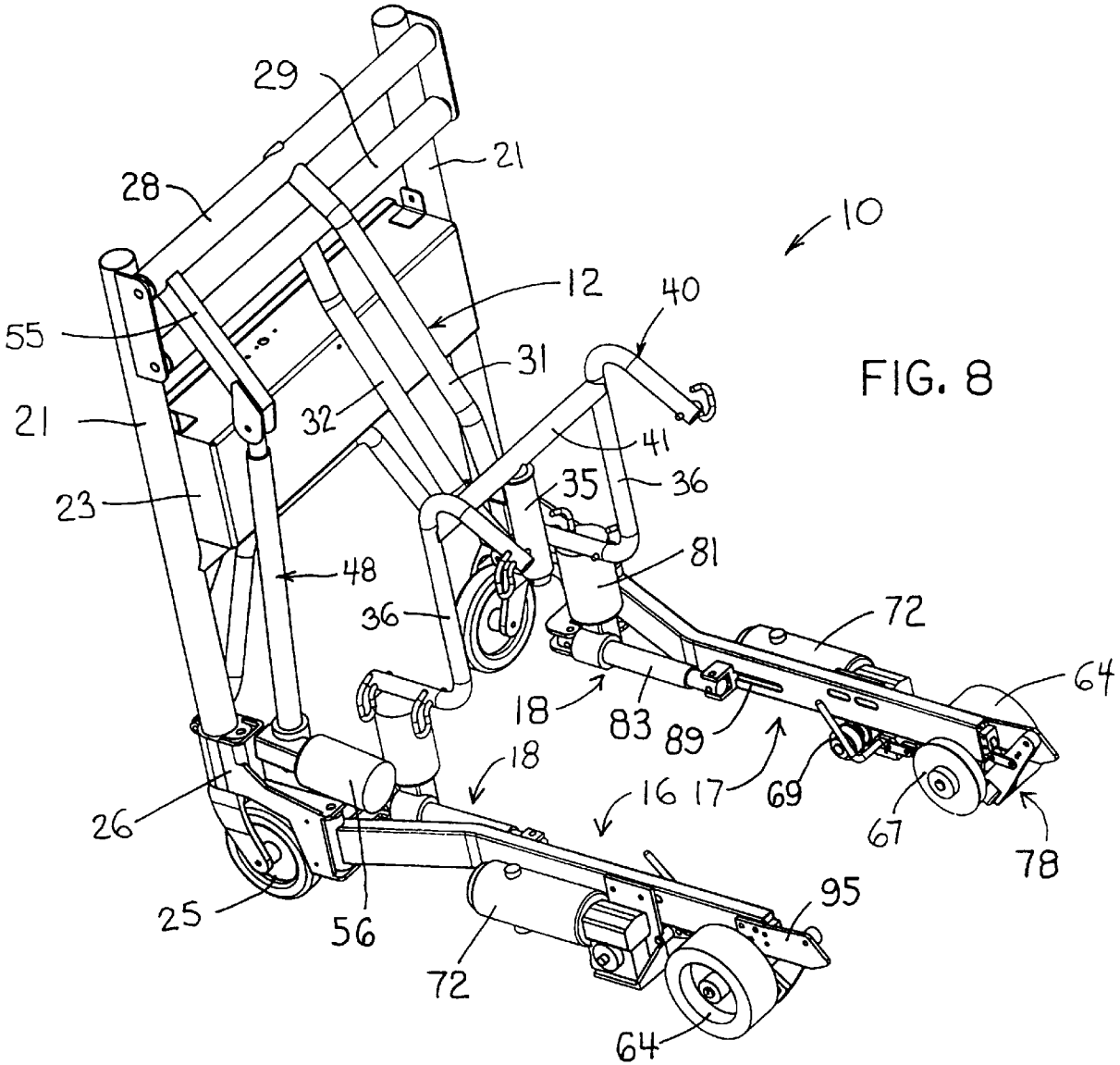
FIG. 8 is a rear perspective view of the lift device with the side legs in their inner positions.
Figure 9:
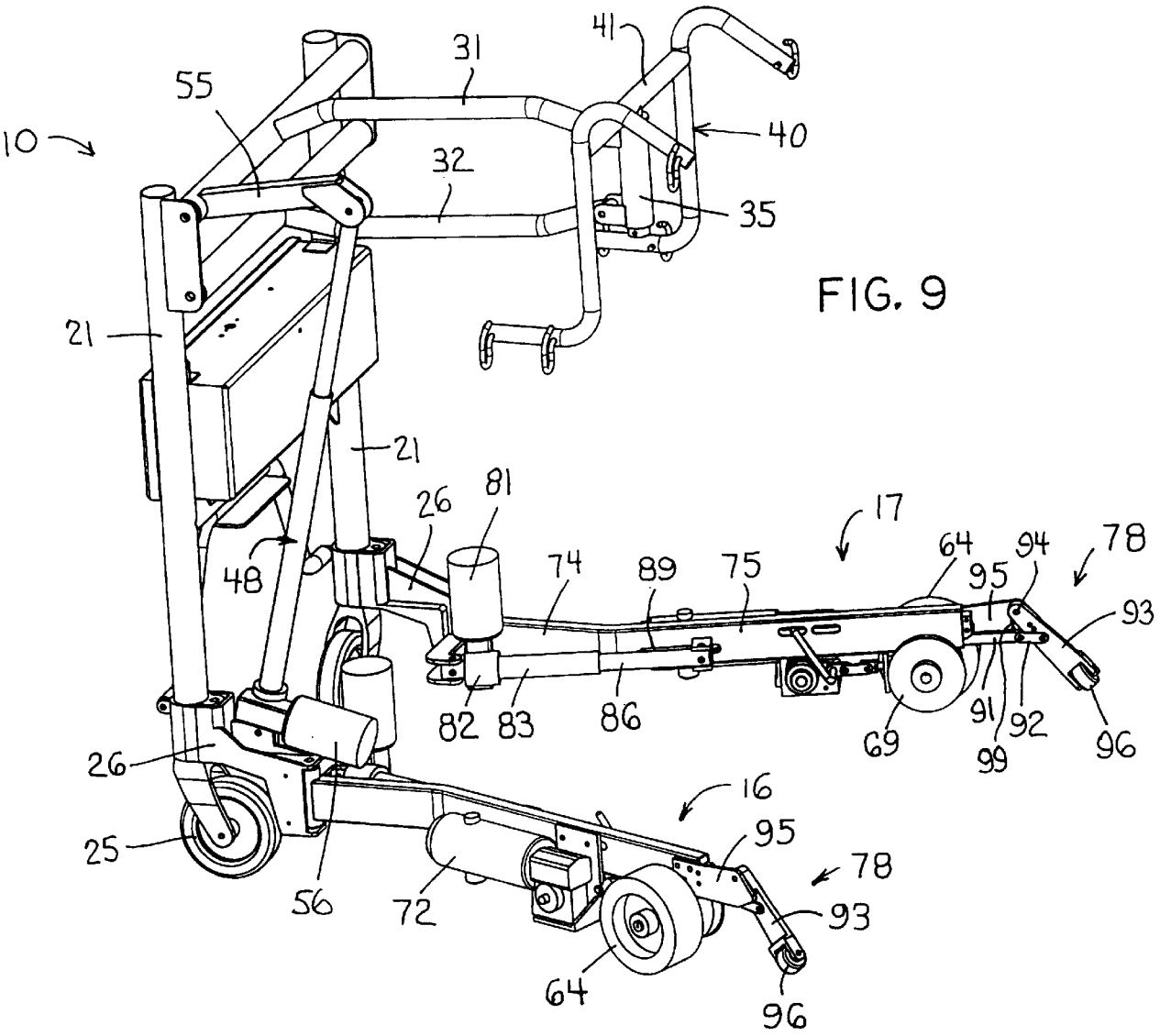
FIG. 9 is a rear perspective view of the lift device with the side legs in their outer positions.
Figure 10:
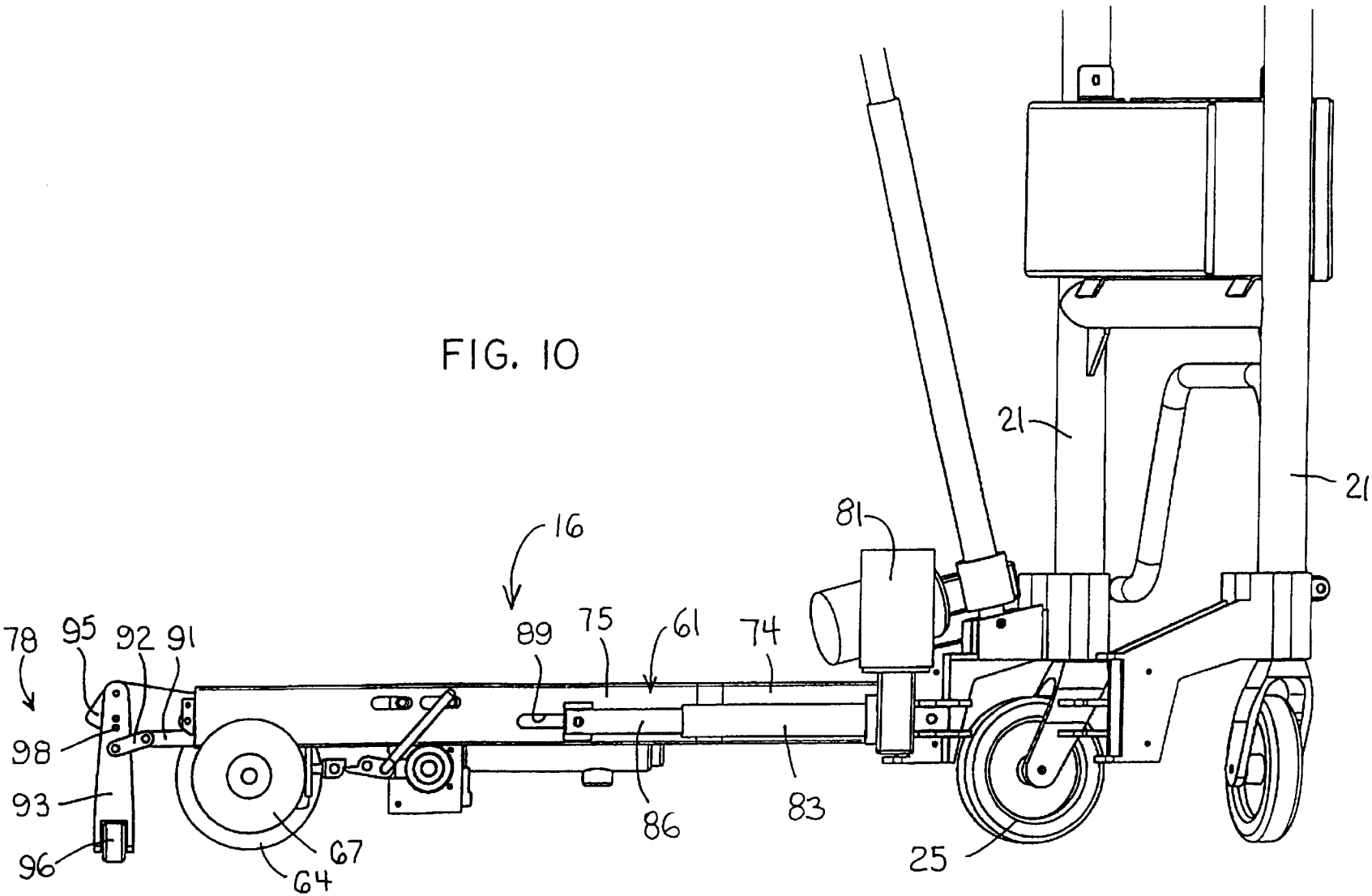
FIG. 10 is a side view showing the inner side of the swing arm when the transverse roller is in an extended position.

This latter roller unit 78 includes a lever 93 which is pivotally supported adjacent its upper end by a hinge 94 having an axis which extends generally horizontally in a sideward or transverse direction, whereby this hinge 94 has its axis extend approximately parallel with the rotational axis of the main support wheel 74. The lever 93 is hingedly supported from a plate or bracket 95 which is fixed to and extends rearwardly from the rear leg part 75. The lever 93 mounts thereon, adjacent the lower end thereof, a roller 96 which is disposed with its rotational axis 97 extending generally perpendicular but nonintersecting with respect to the support axis 94, with this roller axis 97 being positioned so as to project generally in the lengthwise extent of the rear leg part 75 when the transverse roller 96 is engaged with a floor. The lever 93 mounts thereon a pair of either ball or plunger-type spring detents 98 which project from one side of the lever and are adapted for engagement with appropriate detent-recesses 99 formed in the bracket 95, which detent recesses define the floor-engaging position for the transverse roller 96. The transverse roller unit 78, in response to activation of the drive unit 79, is movable from a forward raised storage position (FIG. 8) to an intermediate floor-engaging position (FIG. 10), and thence into a rear raised storage position (FIG. 9), as explained hereinafter.

Figure 11:
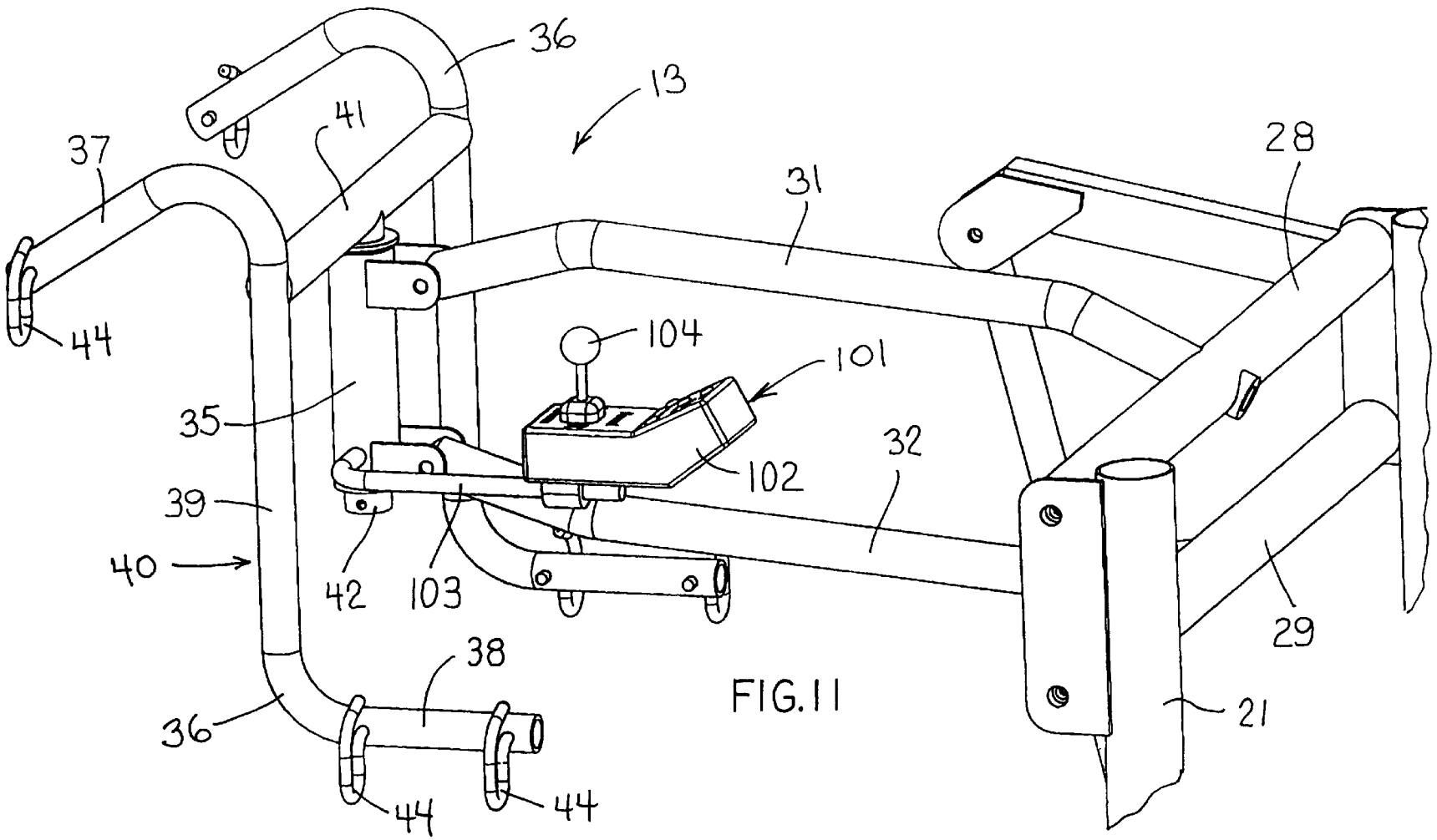
FIG. 11 is a perspective view which illustrates the patient carrier and a joystick controller mounted thereon.
Figure 12:
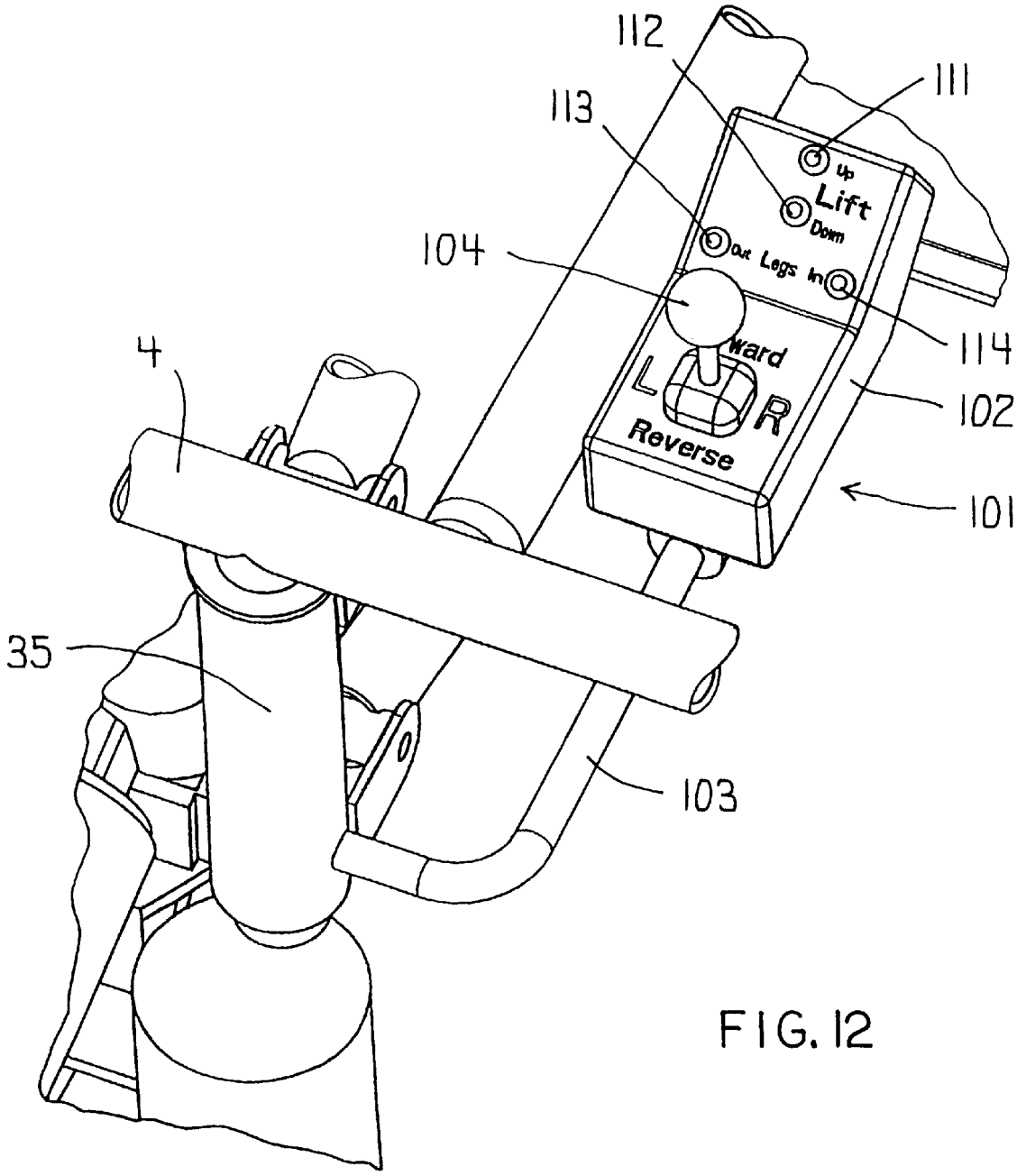
FIG. 12 is a further fragmentary perspective view of the controller.

To provide control over the motorized functions of the lift device 10, the latter is preferably provided with a controller 101 (FIGS. 11 and 12) which includes a housing 102 adjustably secured to a support rod 103, the latter in the illustrated embodiment being fixed to the support tube 35 so as to be readily accessible by the person occupying the lift. The controller 101 preferably includes a joystick 104 to facilitate control over the wheeled drive assemblies 19. The joystick 104, due to forward, backward or sideward movement thereof, or combinations of such movement, permits appropriate driving rotation of the right and left drive wheels 64 to permit either forward or rearward driving of the lift, and/or appropriate differential driving of the rollers 64 so as to permit rightward or leftward steering or turning of the lift, such being conventional with joystick controllers, specifically of the type provided on powered wheelchairs.

The controller 101 also preferably includes other buttons or switches to provide control over the motors associated with the lifting arm 12 and the swingable support legs 16–17. For example, the controller 101 can be provided with switches 111–112 to respectively control the energization of the actuator which respectively effects raising and lowering of the lift arm, and can also be provided with switches 113–114 to control the actuators which respectively control the outward and inward movement of the side legs of the chassis. The switches are diagrammatically illustrated in FIG. 12 as touch-sensitive or push-button switches for convenience in operation by the person supported on the lift, but other conventional switching arrangements can be provided.

The controller 101 and the programming therefor are conventional, and the hardware and software for controlling the motions of the drive wheels in response to the joystick movement are conventional, and in fact are utilized on conventional powered wheelchairs.

It will also be recognized that the electrical cabling for joining the various electrical components has been omitted in the drawings, but that such cabling is conventional and will be positioned so as to extend through or along the various frame and structural components so as to join the controller and the various motors to the control unit and battery as provided in the box 23.

The device 10 of this invention is designed so as to be self-usable by at least those individuals with minimal physical handicaps since, due to the stability of the person supported on the lift as created by the construction of the lift arm and associated patient support, and further due to the accessibility of the person to the controller 101, the person can effectively control all of the functions of the lift device 10 including not only transfer to and from the lift, but also the propelling and mobility of the lift, thereby providing a person with minimal physical handicap the S ability to be much more mobile and self-sufficient. However, it will be appreciated that in some instances the use of the device for lifting or transferring a physically handicapped person may require the assistance of a helper. When assistance of a helper is required, the helper can readily access the controller 101 to thus control the various functions of the device.

In addition, when used in conjunction with a helper, the device 10 also includes a helper support 106 which is movably mounted on the upright front frame adjacent the front side thereof. This helper support 106 comprises a generally U-shaped support member which, in the storage position illustrated by FIGS. 1 and 2, opens upwardly and which mounts, on the horizontal bight part thereof, a generally flat foot-support plate 108. The free ends of the support member 107 are appropriately swingable supported in horizontally-aligned bearings or journals 109 provided adjacent the lower ends of the frame columns 21. These journals can have detents associated herewith for holding the support member 107 in the upright storage position illustrated in FIGS. 1–2. This support member 107 is vertically positioned so that it can be manually swingable displaced downwardly through 180° to thus be suspended downwardly from the journals 109. In this latter position, as indicated by dotted lines in FIG. 2, the foot support member 107 opens upwardly, and the bight thereof is oriented slightly above the floor and the foot plate 108 faces upwardly so that a helper can stand on the foot plate 108 adjacent the front frame, and can grip the front frame with one or both hands, and can also readily reach and hence control the controller 101, whereby the helper can thus ride on the device 10 during movement thereof.

The use and operation of the lifting device 10 according to the present invention now will be briefly described to ensure a complete understanding thereof.

The lift device 10 will typically be maintained in the position illustrated by FIGS. 1–6 wherein the side legs are disposed in the innermost position. When in this position, the drive axles associated with the rear wheels 64 extend in parallel and preferably aligned relationship whereby they extend substantially perpendicular to a central vertical plane which longitudinally intersects the lift device. The wheels 64 are thus oriented to permit forward and rearward driving of the lift device, and are also in their inward positions so that the lift device has minimum width and can be easily moved through normal doorways which are typically as narrow as 28 inches. Further, by appropriate manipulation of the joystick 104 and its cooperation with a conventional controller or programmer for the drive wheels, the right and left drive wheels 64 can be rotated at different rates so as to facilitate right and left steering of the lift device in the same manner as a conventional powered wheelchair. During driving of the lift device, the control of the joystick can be accomplished either by the person who is supported on the lift device, or by a helper who is either riding on or walking beside the lift device.

The lift arm arrangement 12 can be vertically displaced to facilitate movement and transfer of a person. This is accomplished by activation of a suitable control switch or button 111, 112 on the controller 101 to energize the motor 56 in the appropriate direction so as to either extend or contract the ball-screw arrangement 48 to hence displace the swing arm vertically upwardly or downwardly, as desired. In this respect, if a person is supported from the arm in a pair of slings such as a chest and leg sling as illustrated by dotted lines in FIG. 4, then the lift arm mechanism can be swung downwardly into a position as illustrated in FIG. 5 so as to permit the person to be deposited on the floor, or conversely to be lifted from the floor. Similarly, a person supported from the lift arm can be lifted upwardly into a substantially standing position by moving the lift arm arrangement upwardly into the position illustrated in FIG. 6, with the latter part of this movement normally occurring solely with the assist of the chest sling 15. Returning the person from a standing to a suspended or seated condition occurs by a reversal of the above movement.

By means of vertical displacement of the lift arm arrangement 12, it is also possible to transfer a person from a bed or chair to the lift arm, or vice versa. For example, the slings 14–15 can be positioned around the upper and lower portions of a person when laying on a bed or seated in a chair, and the lift arm 12 swingably lowered to a suitable position so as to enable the slings to be attached thereto. Upward raising of the lift arm 12 then permits the person to be safely lifted away from the chair or bed, with the person being suitably suspended from the arm. The suspension of the person from the arm is stable and secure, and does not create significant discomfort or fear to the person since the slings constitute a four-point suspension wherein all suspension points are secured to the stabilized support frame 40 which maintains a stable orientation, even during vertical swinging movement of the lift arm arrangement, thus prevent the suspended person from undergoing undesired swinging movement in either front-to-back or side-to-side directions.

With a person suspended from the lift arm, it is also possible and convenient for the legs of the person to be projected forwardly since the significant open space between the sidewardly-spaced front columns 21 thus provides a significant clearance space to permit convenient projection of the person's legs therethrough without having to be disposed in an uncomfortable straddling relationship with respect to a frame structure. Further, since the lifting mechanism 47 is disposed adjacent one side of the frame, this further increases the available space for the person, and prevents interference with the support of the person and the movement thereof by the lift arm arrangement.

The low and cantilevered nature of the side support legs 16–17, and the openness of the region thereabove, also facilitates the positioning of the lift so that the side legs 16–17 can project under a bed, thereby facilitating transfer of a person between a bed and the lift device.

The lift 10 is also particularly desirable for use with and to facilitate the transfer of a handicapped person to or from a wheelchair. When such is desired, the appropriate button or switch 113, 114 on the controller 101 is activated to cause activation of the swing actuators 18 so as to cause the side legs 16–17 to swing outwardly into the diverging outer positions illustrated by FIG. 7. The activation of the swing actuators 18 causes the motors 81 to be energized and this causes rearward extension of the drive rods 86 which slide the yokes 88 rearwardly. During the initial rearward sliding of each yoke 88 rearwardly, and the corresponding initial rearward displacement of the push rod 91, the transverse roller unit 78 is activated in that the lever 93 is pivoted rearwardly and downwardly from the storage position of FIG. 8 until the roller 96 contacts the floor (FIG. 10) and effects upward lifting of the rear end of the respective leg 16–17, thereby causing the respective drive roller 64 to move upwardly out of engagement with the floor. The rearward swinging of lever 93 continues until the detents 98 engage the detent recesses 99, in which position the roller 96 on each side leg is in rolling engagement with the floor. Continued rearward extension of the rod 86 due to continuous energization of the drive motor 81 now causes the rearward extending force of the rod 86 to be applied directly to the side leg arrangement, which force is offset relative to the hinge axis 62 and hence causes the side leg to swing outwardly about the axis 62 due to the rolling engagement between the transverse roller 96 and the floor. This outward swinging of the side leg 16–17 continues until limited by the stop associated with the hinge 62. However, since the drive motor 81 remains energized and continuous to further extend the rod 86, the driving force applied from the rod 86 onto the push rod 91 is now effective to release the detents 98–99 and thus cause further rearward extension of the push rod 91 which in turn causes the lever 93 to be swung rearwardly from the position of FIG. 10 into the position of FIG. 9, thereby causing the transverse roller 96 to be swung upwardly out of engagement with the floor so that the main drive wheel 64 is again lowered into engagement with the floor. In this condition, the side legs 16–17 are now flared or angled outwardly relative to one another as they project rearwardly so as to define therebetween an enlarged open region which is fully open at the rearward end of the device to thus facilitate positioning of a chair (i.e. a wheelchair) therebetween. With a wheelchair positioned between the side legs 16–17, transfer of a person between the lift and the wheelchair can be readily and safely accomplished.

With the legs 16–17 in their outer flared position as illustrated in FIG. 7, and with a person supported on the lift arm 12, the lift device 10 is still capable of being driven by appropriate energization of the drive wheels 64 through activation of the controller 101. While the drive wheels 64 are admittedly in a somewhat skewed relationship relative to the driving direction when the legs are angled outwardly as shown in FIG. 7, nevertheless the outward angle is sufficiently small (i.e., typically about 20° in the preferred embodiment) as to require only minimal side slippage of the drive wheels 64, and thus propelled movement of the lift 10 is possible. Further, by use of the controller 101 so as to differentially control the driving rotation of the right and left drive wheels 64, the lift device 10 can be turned or effectively rotated even when the side legs are in the outwardly flared position.

Figure 4:
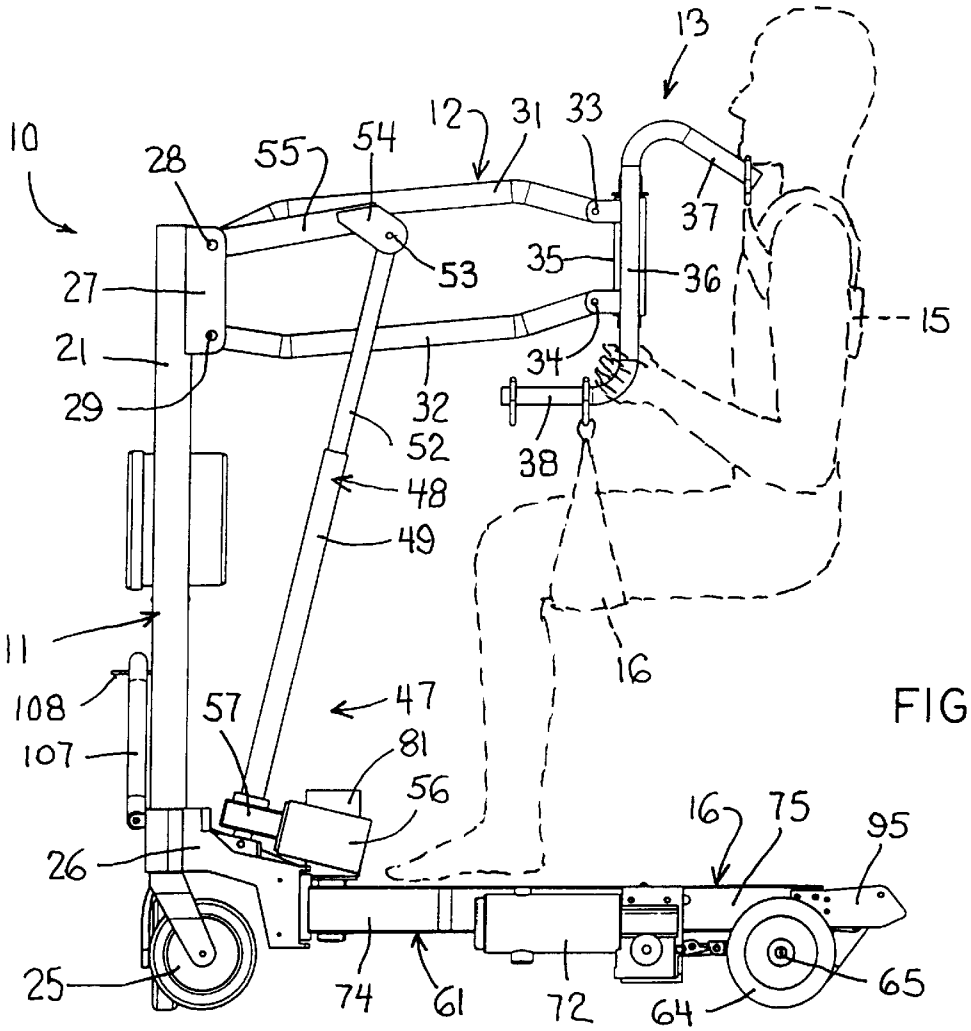
FIG. 4 is a side elevational view of the lift as shown in FIG. 1.
Figure 5:
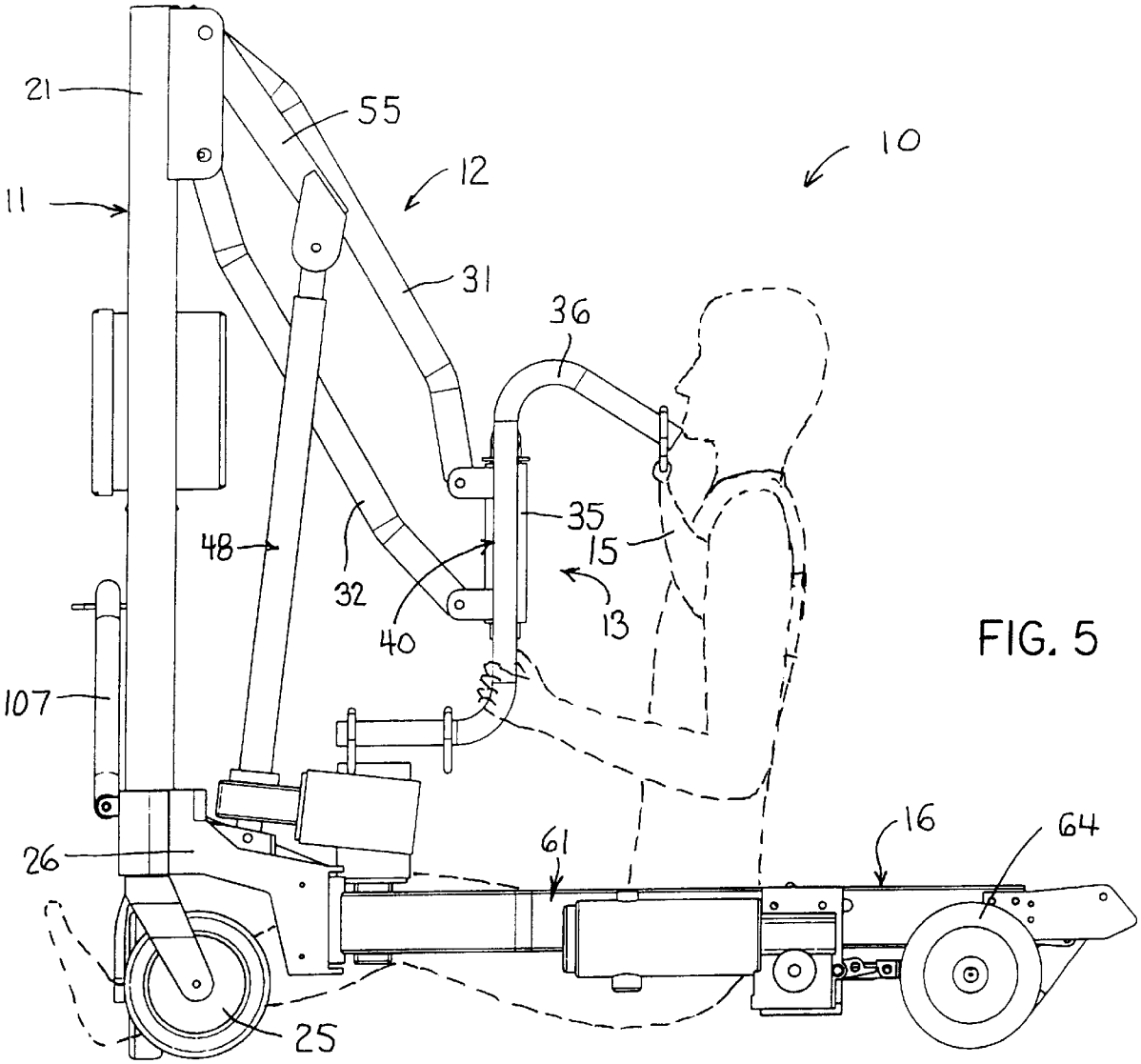
FIG. 5 is a side elevational view showing the lifting arm in a lowered position.
Figure 6:
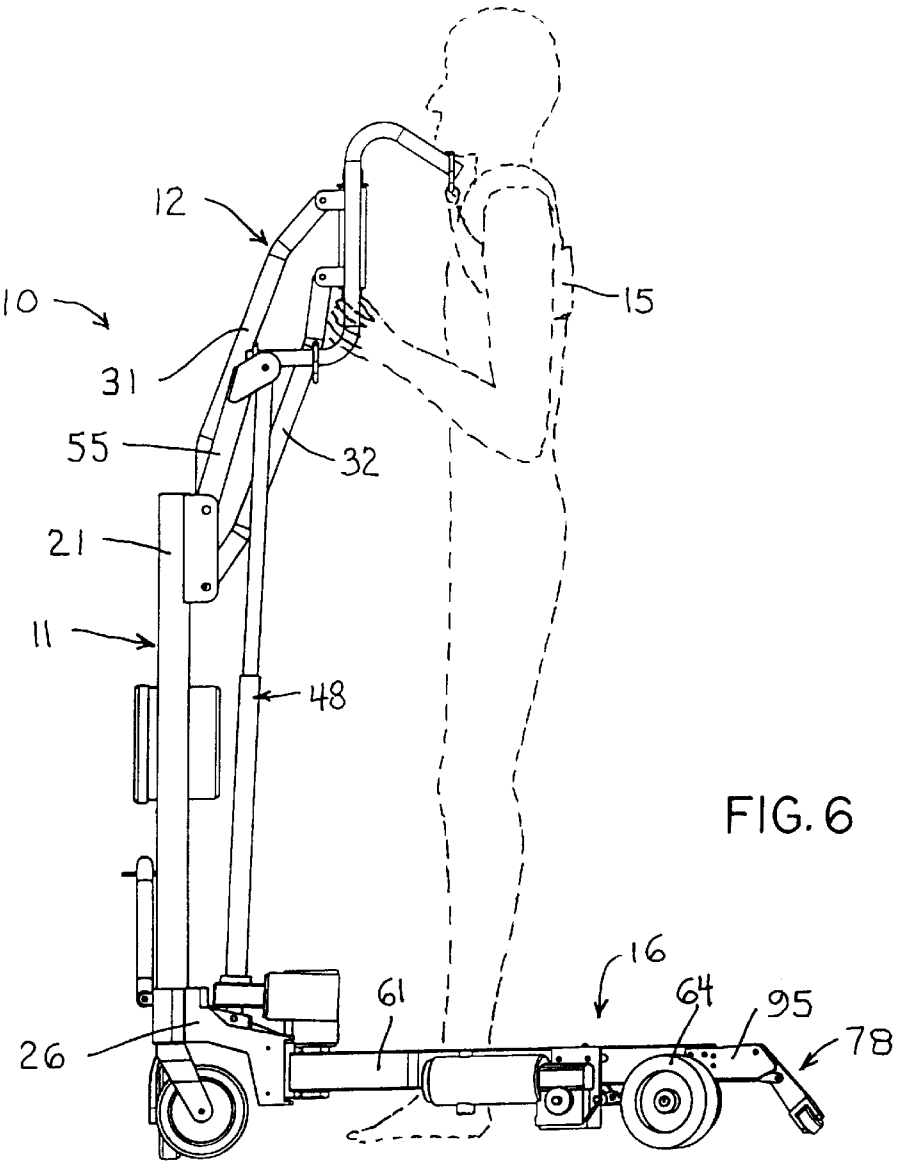
FIG. 6 is a side view showing the lifting in its uppermost position.

When it is desired to return the side legs 16–17 from the angled or skewed position of FIG. 7 to the inward compact position of FIG. 4, the controller 101 is utilized to energize the motors 81 of the swing actuators so as to cause the side legs to be swung inwardly, which movement is the reverse of the outward movement described above.

In the illustrated and preferred embodiment, the motors 81 associated with the swing actuators for the side legs are preferably simultaneously actuated so that sideward displacement of the side legs preferably occurs simultaneously. It will be appreciated, however, that sideward swinging movement of the side legs could be programmed to occur sequentially, if desired, so long as proper stability of the lift is maintained.

While the preferred embodiment also discloses the swing actuators for the side legs being designed to effect control over the movement of the transverse roller units 78 provided at the rear ends of the side legs, it will be appreciated that the movement of the transverse roller units can be controlled by separate actuators (i.e. drive motors) which can be actuated in a timed or controlled manner relative to the motors associated with the swing actuators.

Although a particular preferred embodiment of the invention has been disclosed in detail for illustrative purposes, it will be recognized that variations or modifications of the disclosed apparatus, including the rearrangement of parts, lie within the scope of the present invention.

The embodiments of the invention in which an exclusive property or privilege is claimed are defined as follows:

1. A patient lift and transfer device, comprising:

a wheeled chassis including an upright frame and a pair of horizontally elongated side legs connected to a lower part of said upright frame and projecting rearwardly therefrom in cantilevered and sidewardly spaced relation;

said side legs being movably connected to said upright frame for horizontal transverse movement between sidewardly contracted and expanded positions;

a leg actuating mechanism cooperating between said upright frame and said legs for causing movement of said pair of legs in opposite direction as they are moved between said contracted and expanded positions;

said wheeled chassis being rollingly supported on sidewardly spaced pairs of front and rear wheels which are rotatable solely about axes which extend transversely with respect to the elongated direction of said side legs, the pair of rear wheels being disposed adjacent rear free ends of said side legs, and driving mechanisms interconnected to the rear wheels for effecting powered driving of the chassis;

a lifting arm arrangement vertically swingably mounted on said upright frame and projecting rearwardly therefrom, said lifting arm arrangement including elongate upper and lower swing arms which at one end are mounted on said upright frame for swinging movement about vertically spaced but substantially parallel upper and lower horizontally-extending swing axes respectively;

a patient support frame connected to the other ends of said upper and lower arms at vertically spaced and substantially parallel upper and lower horizontally-extending pivot axes respectively, said support frame including a rigid support which extends between and is pivotally connected to said other ends at said upper and lower pivot axes so as to maintain a predefined spacing between said pivot axes during vertical swinging displacement of said lifting arm arrangement; and an actuating device connected to said lifting arm arrangement for controlling vertical swinging thereof about said upper and lower swing axes.

2. A device according to claim 1, wherein said legs are connected adjacent front ends thereof to said upright frame for generally horizontal swinging movement of each said leg between said contracted and expanded positions, wherein said driving mechanisms effect driving of the rear wheels, and a downwardly-movable transverse roller assembly mounted on each said leg adjacent a rear free end thereof to effect lifting of the rear end of the respective leg and of the drive wheel carried thereby to permit rolling displacement of the side leg between said contracted and expanded positions.

3. A device according to claim 2, wherein said transverse roller assembly is actuatable by the leg actuating mechanism and is automatically retracted upwardly to disengage the floor when the leg reaches its expanded position so that the drive wheel re-engages the floor.

4. A device according to claim 1, including a manually-actuated controller mounted on said support frame in close proximity to a person carried on the lift, said controller including a joystick.

5. A device according to claim 1, wherein said support frame includes a rigid patient supporting structure which is supported on said support member for sideward pivoting movement about a generally vertical axis, said patient supporting structure having attachment means associated therewith for releasable attachment with a patient-supporting sling.

6. A device according to claim 1, wherein said elongate upper and lower swing arms are maintained in substantially parallel relationship to one another.

7. A device according to claim 1, including a manually-actuated controller mounted on said support frame in close proximity to a person carried on the lift, the controller including a joystick for controlling the driving mechanisms which effect driving of said rear wheels, said controller also including a manually-engageable switch positioned adjacent the joystick for controlling a driving unit which is part of said actuating device to control vertical swinging of said lifting arm.

8. A patient lift and transfer device, comprising:

a wheeled chassis including an upright frame;

said chassis including a pair of horizontally elongated side legs movably connected adjacent front ends thereof to a lower part of said upright frame and projecting rearwardly therefrom in cantilevered and sidewardly spaced relation, said side legs being horizontally swingably movable between sidewardly contracted and expanded positions;

a leg actuating mechanism cooperating between said upright frame and said legs for causing movement of said pair of legs in opposite directions as they are moved between said contracted and expanded positions;

a drive roller mechanism associated with each said leg and including a driving roller which is mounted on each said leg adjacent a rear free end thereof for supportive and driving engagement with a support surface such as a floor, said driving roller adjacent the rear free end of said leg being supported for rotation about an axis which is fixed relative to the rear leg and extends transversely relative to the elongated direction of the rear leg for controlling forward and rearward movement of the lift and transfer device;

a lifting arm arrangement vertically swingably mounted on said upright frame and projecting rearwardly therefrom;

a patient support structure connected to said lifting arm arrangement adjacent a rearward free end thereof for permitting support of a person;

an actuating device connected to said lifting arm arrangement for controlling vertical swinging thereof relative to said upright frame; and a manually-actuated controller mounted on said patient support structure in close proximity to a person carried by the lift for controlling said drive roller mechanism and said actuating device, said controller including a manually-actuatable joystick.

9. A device according to claim 8, wherein said legs are connected adjacent front ends thereof to said upright frame for generally horizontal swinging movement of each said leg between said contracted and expanded positions, and are actuatable by the leg actuating mechanism to effect displacement of the side leg between said contracted and expanded positions.

10. A device according to claim 8, including a manually-actuated controller mounted on said patient support structure in close proximity to a person carried by the lift device for controlling said drive roller mechanism and said actuating device, said controller including a joystick for controlling said drive roller mechanism.

11. A device according to claim 8, wherein the drive roller mechanism and the actuating device each include a separate electric motor, the joystick of the controller effecting control over the motor of the drive roller mechanism, and the controller also having a manually-engageable switch positioned in close proximity to the joystick for controlling the motor of the actuating device.

12. A device according to claim 8, wherein the drive roller mechanism and the leg actuating mechanism each include a separate electric motor, the joystick of the controller effecting control over the motor of the drive roller mechanism, and the controller also having a manually-engageable switch positioned in close proximity to the joystick for controlling the motor of the leg actuating device.

13. A patient lift and transfer device, comprising;

a wheeled chassis including an upright frame;

said chassis including a pair of horizontally elongated side legs movably connected to a lower part of said upright frame and projecting rearwardly therefrom in cantilevered and sidewardly spaced relation, said side legs being horizontally transversely movable between sidewardly contracted and expanded positions;

a leg actuating mechanism cooperating between said upright frame and said legs for causing movement of said pair of legs in opposite directions as they are moved between said contracted and expanded positions;

a drive roller mechanism associated with said wheeled chassis for supportive and driving engagement with a support surface such as a floor;

a lifting arm arrangement vertically swingably mounted on said upright frame and projecting rearwardly therefrom;

a patient support structure connected to said lifting arm arrangement adjacent a rearward free end thereof for permitting support of a person;

an actuating device connected to said lifting arm arrangement for controlling vertical swinging thereof relative to said upright frame;

a manually-actuated controller mounted on said patient support structure in close proximity to a person carried by the lift for controlling said drive roller mechanism and said actuating device, said controller including a manually-actuated joystick; and the drive roller mechanism, the actuating device and the leg actuating mechanism each including a separate electric motor, the joystick of the controller effecting control over the motor of the drive roller mechanism, and the controller also having first and second switches which control the respective motors of the actuating device and the leg actuating mechanism.

14. A device according to claim 13, wherein said lifting arm arrangement includes elongate upper and lower swing arms which at one end are mounted on said upright frame for swinging movement about vertically spaced but substantially parallel upper and lower horizontal swing axes respectively, said patient support structure connected to the other ends of said upper and lower swing arms at vertically spaced and substantially parallel upper and lower horizontal pivot axes respectively.

15. A device according to claim 14, including a manually-actuated controller mounted on said patient support structure in close proximity to a person carried by the lift for controlling said drive roller mechanism and said actuating device, said controller including a joystick.

16. A patient lift and transfer device, comprising:

a wheeled chassis including an upright frame;

said chassis including a pair of horizontally elongated side legs movably connected adjacent front ends thereof to a lower part of said upright frame and projecting rearwardly therefrom in cantilevered and sidewardly spaced relation, said side legs being horizontally swingably movable between sidewardly contracted and expanded positions;

a leg actuating mechanism cooperating between said upright frame and said legs for causing movement of said pair of legs in opposite directions as they are moved between said contracted and expanded positions;

a drive roller mechanism associated with each said legs and including a driving roller which is mounted on each said leg adjacent a rear free end thereof for supportive and driving engagement with a support surface such as a floor;

a lifting arm arrangement vertically swingably mounted on said upright frame and projecting rearwardly therefrom;

a patient support structure connected to said lifting arm arrangement adjacent a rearward free end thereof for permitting support of a person;

an actuating device connected to said lifting arm arrangement for controlling vertical swinging thereof relative to said upright frame; and a downwardly-movable transverse roller assembly mounted on each said leg adjacent a rear free end thereof to effect lifting of the rear end of the respective leg and of the drive wheel carried thereby to permit rolling displacement of the side leg between said contracted and expanded positions.

17. A device according to claim 16, wherein the transverse roller assembly is actuatable by the leg actuating mechanism.

* * * * *

UNITED STATES PATENT AND TRADEMARK OFFICE

CERTIFICATE OF CORRECTION

PATENT NO. : 6,092,247
DATED : July 25, 2000
INVENTOR(S) : Harold R. Wilson

It is certified that error appears in the above-identified patent and that said Letters Patent is hereby corrected as shown below:

Column 14,
Delete lines 24-28 in their entirety.
Line 29, change "16." to -- 15. --.
Line 63, change "17." to -- 16. --.
Line 66, insert the following:

-- 17. -- A device according to Claim 16, wherein said transverse roller assembly is automatically retracted upwardly to disengage the floor when the leg reaches its expanded position so that the drive wheel re-engages the floor. --.

Signed and Sealed this

Twenty-third Day of October, 2001

*Attest:*

Nicholas P. Godici

NICHOLAS P. GODICI
*Acting Director of the United States Patent and Trademark Office*

*Attesting Officer*